US005366141A

United States Patent [19]

Stone

[11] Patent Number: 5,366,141

[45] Date of Patent: Nov. 22, 1994

[54] RECLOSEABLE PAPERBOARD CONTAINER WITH OPTIONAL CLOSURE MEANS

[75] Inventor: James L. Stone, Grand Rapids, Mich.

[73] Assignee: Federal-Mogul Corporation, Southfield, Mich.

[21] Appl. No.: 194,820

[22] Filed: Feb. 14, 1994

Related U.S. Application Data

[63] Continuation of Ser. No. 989,208, Dec. 11, 1992, abandoned.

[51] Int. Cl.[5] ..... B65D 5/48; B65D 5/54

[52] U.S. Cl. ..... 229/120.03; 229/120.11; 229/120.18; 229/149; 229/272

[58] Field of Search ..... 229/120.03, 120.11, 229/120.18, 148, 149, 150, 142, 222, 223; 206/831; 40/312

[56] References Cited

U.S. PATENT DOCUMENTS

| | | | |
|---|---|---|---|
| 1,141,489 | 6/1915 | Richardson | 229/142 |
| 2,054,596 | 9/1936 | Ford | 40/312 |
| 2,390,412 | 12/1945 | Axberg | 229/222 |
| 2,403,047 | 7/1946 | Buttery | 229/223 |
| 2,481,288 | 9/1949 | Cage | 229/150 |
| 3,037,684 | 6/1962 | Andrews et al. | 229/150 |
| 3,233,818 | 2/1966 | Bixler et al. | 229/150 |
| 3,263,899 | 8/1966 | Collura et al. | 229/222 |
| 3,455,497 | 7/1969 | Gillam | 206/831 |
| 3,648,921 | 3/1972 | Lock | 229/222 |
| 3,946,937 | 3/1976 | Forbes, Jr. et al. | 229/222 |
| 4,163,492 | 8/1979 | Rella | 229/150 |
| 4,398,661 | 8/1983 | Schillinger | 229/120.18 |
| 4,746,052 | 5/1988 | Schmissrauter | 229/150 |
| 4,903,892 | 2/1990 | McNair et al. | 229/120.11 |
| 5,048,690 | 9/1991 | Zimmerman | 229/120.11 |

FOREIGN PATENT DOCUMENTS

| | | | |
|---|---|---|---|
| 83511 | 7/1964 | France | 229/120.18 |
| 434097 | 10/1967 | Switzerland | 229/223 |
| 674190 | 5/1990 | Switzerland | 229/149 |
| 11369 | of 1906 | United Kingdom | 229/149 |
| 449968 | 7/1936 | United Kingdom | 229/223 |
| 2073707 | 10/1981 | United Kingdom | 229/223 |

*Primary Examiner*—Gary E. Elkins
*Attorney, Agent, or Firm*—Lawrence J. Shurupoff

[57] ABSTRACT

A recloseable paperboard container includes a bottom wall, opposing front and back walls, and opposing side walls. The back wall includes a first major top flap connected to an upper transverse edge of the back wall, the first major top flap having a top edge lock tab protruding from an outer edge of the first major top flap. The front wall includes a second major top flap connected to an upper transverse edge of the front wall, the second major top flap having a top edge slit disposed on the upper transverse edge of the front wall. The container is sealed either by securing the second major top flap over the first major top flap using adhesive, or by securing the first major top flap over the second major top flap through engagement of the top edge lock tab with the top edge slit. An integral tear strip extends across the second major top flap and is used to open a container sealed by securing the second major top flap over the first major top flap. After the container is initially opened, it is reclosed by engaging the top edge lock tab with the top edge slit. A minor top flap includes a "broken set" tab for indicating that the container has been previously opened and that a product has been removed.

8 Claims, 7 Drawing Sheets

RECLOSEABLE PAPERBOARD CONTAINER WITH OPTIONAL CLOSURE MEANS

This is a continuation of co-pending application Ser. No. 989,208 filed on Dec. 11, 1992, abandoned.

FIELD OF THE INVENTION

The present invention generally relates to paperboard containers and cartons and the like. More particularly, the present invention is concerned with a recloseable paperboard container for holding product sets having optional closure means.

BACKGROUND OF THE INVENTION

In a variety of consumer packaging applications, it is important to have paperboard containers which provide enhanced product protection during storage and transit and which provide evidence of tampering with the products within a container. Such paperboard containers are particularly important in applications involving containers which hold product sets. Without a strong, stable paperboard container, a product could break through an ill-handled container during transit, resulting in a ruptured container and an incomplete or damaged product set. In addition, without a tamper evidence closure, a portion of the product set could be removed from the paperboard container or tampered with prior to a sale to a consumer.

One exemplary container for holding product sets uses a hierarchy of multiple containers. Components of a product set are placed in small individual containers, and the small individual containers are subsequently placed in a single large container. The containers are sized so that the small containers snugly fit within the large container. The containers are typically designed using conventional seal end closures or tuck closures. Conventional tuck closures include "cereal-type" closures commonly used on dry cereal cartons, single tuck flap closures, closures using both a tuck flap and tongue lock, and edge lock closures which use a lock tab and associated lock slit.

In order to provide tamper evident closure, conventional containers use a combination of the "cereal-type" tuck closure and a tear strip. These containers are designed with two major flaps, an outer closure flap and an inner closure flap, hingedly connected to opposing side walls of the container. The outer closure flap includes a tear strip extending across the flap and a cereal-type lock slot positioned near the tear strip on the flap. The inner closure flap includes a lock tab along its outer edge. The container is originally sealed by gluing a portion of the outer closure flap over the inner closure flap. The container is opened by removing the tear strip from the outer closure flap, and the container is reclosed by placing the inner closure flap over the outer closure flap and interlocking the lock tab with the lock slot.

Conventional containers of the above-identified type suffer from disadvantages which severely restrict their use in certain consumer packaging applications, particularly where the packaged product constitutes a fragile product set. A major drawback of conventional containers which hold product sets is that a consumer is unable to view or access all of the products without opening both the single large container and the small individual containers contained within it. Opening every container to view or access all the products of a set is time-consuming and inconvenient. Another drawback of using a hierarchy of containers to package product sets is that an abundant amount of paperboard is required to produce all of the containers for holding the product sets. Yet another drawback for using a hierarchy of containers is the slow line speed for filling the containers with products, for the small individual containers are separately filled with products and are then inserted into the single large container. Furthermore, the present inventor has discovered that the aforementioned type of tamper evident closure does not provide a sufficient measure of security for fragile or heavy products. The inventor has found that once the container is opened by removing the tear strip and reclosed using the "cereal-type" closure, the "cereal-type" closure may accidently reopen due to pressure against the interlocking flaps. The lock tab and lock slot of the "cereal-type" closure cannot withstand much abuse without disengaging from one another.

Consequently, a need exists for improvements in the design of paperboard containers which will result in improved consumer viewability and accessibility of a product set within the container, provide tamper evident and strong positive closure, and provide enhanced product protection.

SUMMARY OF THE INVENTION

The present invention provides a recloseable paperboard container designed to satisfy the aforementioned needs. Instead of using a hierarchy of containers for holding product sets, the recloseable paperboard container of the present invention includes paperboard partitions in the interior of the container to divide the products within a product set into separate cells. By using partitions instead of individual closed containers to separate the products of a set, a consumer can easily view or access all the products of the set and the container can be more quickly filled with products. The use of partitions also requires less paperboard than using separate containers to hold products of a set. Despite the use of less paperboard, the recloseable container is manufactured to provide durable, tear-resistant partitions which impart strength and stability to the container. Moreover, the cells created by the partitions are designed to protect the products contained therein. Strength at the opening of the recloseable container is provided by a tamper evident closure which can withstand substantial abuse without opening.

An additional feature of the recloseable container allows the container to be initially sealed using two different closure options. One of the closure options is especially adapted for the situation where the container is produced and filled with products at the same manufacturing location. The other closure option is especially adapted for the situation where the container is produced at one manufacturing location and filled with products at a different location.

Accordingly, the present invention relates to a recloseable paperboard container which includes a bottom wall, opposing front and back walls, and opposing side walls. The back wall includes a first major top flap hingedly connected to an upper transverse edge of the back wall, and the front wall includes a second major top flap connected to an upper transverse edge of the front wall. The first major top flap has a top edge lock tab protruding from an outer edge of the first major top flap. The top edge lock tab is adapted to be received by a top edge slit disposed on the upper transverse edge of the front wall.

The container may be originally sealed by either securing the second major top flap over the first major top flap using adhesive, or by securing the first major top flap over the second major top flap through engagement of the top edge lock tab with the top edge slit. After the container is initially opened by disengaging the first and second major top flaps from one another, the container is reclosed by engaging the top edge lock tab with the top edge slit.

BRIEF DESCRIPTION OF THE DRAWINGS

The advantages of the present invention will become apparent upon reading the following detailed description and upon reference to the accompanying drawings, in which.

Figure 1:
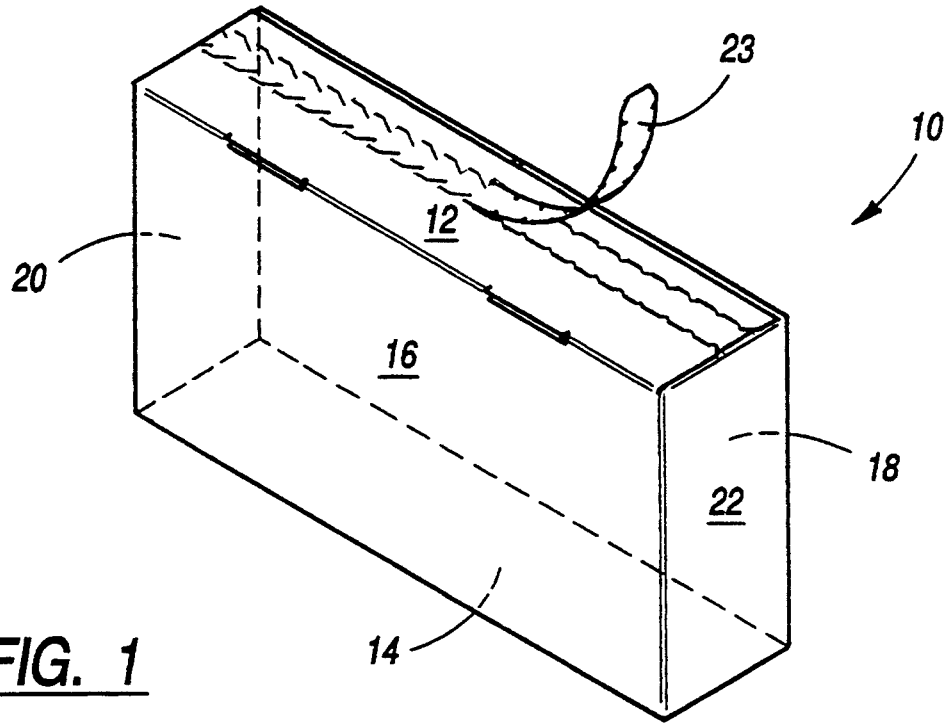
FIG. 1 is a perspective view of the recloseable paperboard container of the present invention, the container being shown in its originally sealed form with a tear strip partially pulled open.

While the invention is susceptible to various modifications and alternative forms, a specific embodiment thereof has been shown by way of example in the drawings and will herein be described in detail. It should be understood, however, that it is not intended to limit the invention to the particular forms disclosed, but on the contrary, the intention is to cover all modifications, equivalents, and alternatives falling within the spirit and scope of the invention as defined by the appended claims.

DESCRIPTION OF THE PREFERRED EMBODIMENT

Referring now to the drawings and more particularly to FIG. 1, there is shown a perspective view of an exemplary recloseable paperboard container, generally designated by the reference numeral 10, which comprises the preferred embodiment of the present invention. In particular, FIG. 1 shows a recloseable container which is a six-sided parallelopiped enclosure formed of three pairs of opposing, generally rectangular walls or panels. More specifically, the container 10 includes opposing top and bottom walls 12 and 14, opposing front and back walls 16 and 18, opposing side walls 20 and 22.

Figure 11:
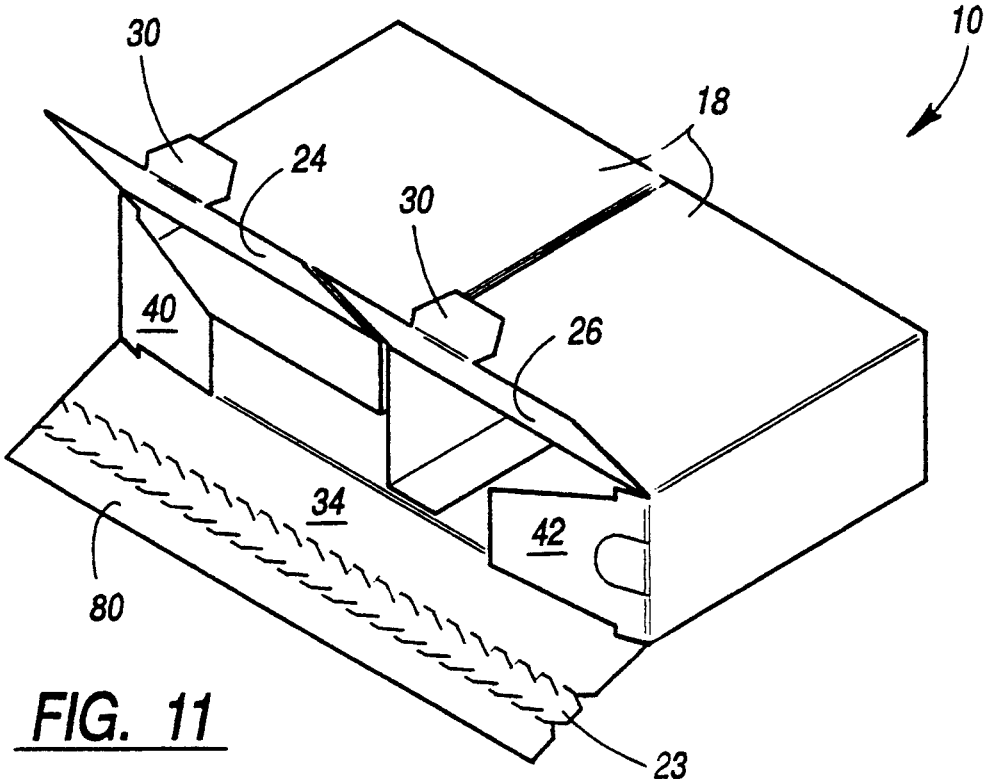
FIGS. 11 and 12 are perspective views of the recloseable paperboard container of the present invention, illustrating the sequence in which the top end flaps are folded and secured to close the top of the recloseable container.

Referring to both FIGS. 1 and 11, the top wall 12 is defined by minor flaps 40 and 42, a pair of major top flaps 24 and 26, and a third major top flap 34. If the container 10 is initially closed by automatic sealing, the top wall 12 is formed by folding the third major top flap 34 over the pair of major top flaps 24 and 26, which, in turn, are folded over the minor flaps 40 and 42. Thus, the third major top flap 34 of an automatically-sealed container is the outermost flap of the top wall 12. The third major top flap 34 is provided with an integral and continuous tear strip 23 extending completely across the third major top flap 34. The construction of the tear strip 23 is conventional and it effectively functions as a means for convenient opening of the container 10 once the container 10 has been filled with the requisite contents and automatically-sealed. Tearing or pulling away of the tear strip 23 as indicated in FIG. 1 effectively releases the sealed major top flaps 24, 26 and 34 of the top wall 12 and opens the container 10 as depicted in FIG. 2.

Figure 2:
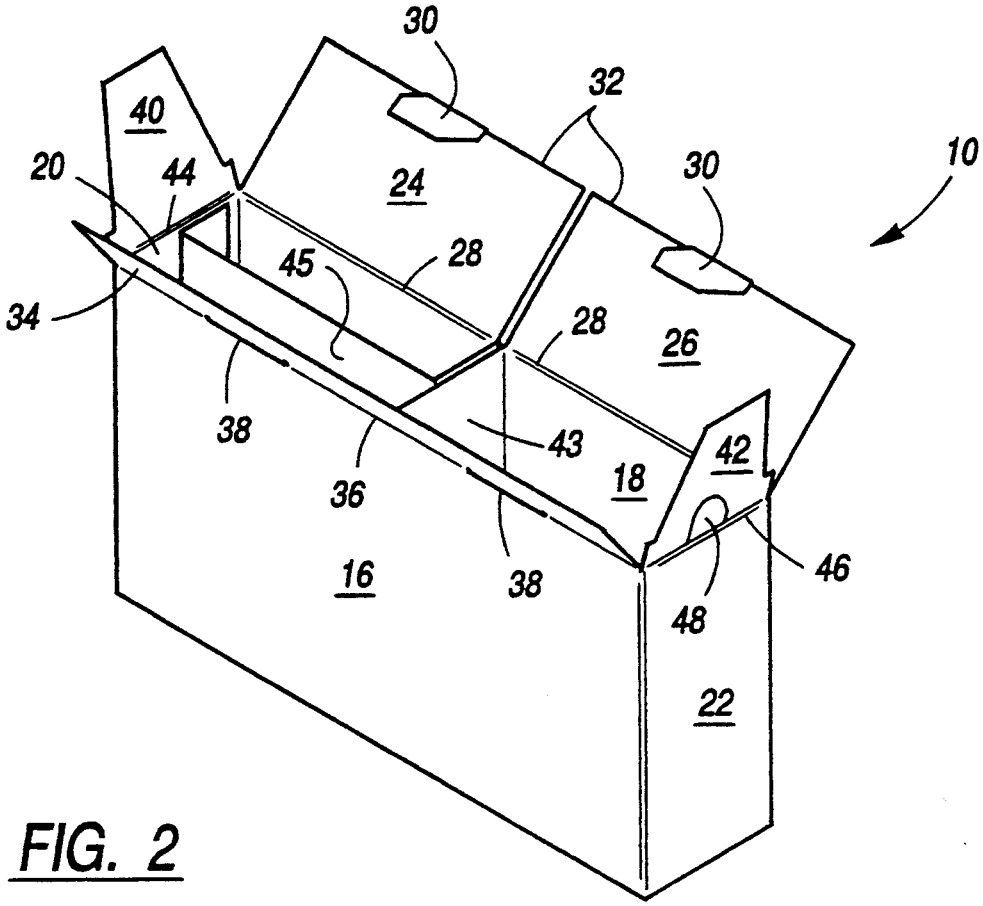
FIG. 2 is a perspective view of the recloseable paperboard container of the present invention, the container being shown in its open condition with the tear strip completely removed.

Referring now to FIG. 2, there is shown a perspective view of the recloseable paperboard container of the present invention with the tear strip completely removed and top flaps pulled open. The back wall 18 includes the pair of major top flaps 24 and 26 hingedly connected to an upper transverse edge 28 of the back wall 18 and located adjacent to one another. The pair of major top flaps 24 and 26 each include a top edge lock tab 30 protruding from their outer edges 32. The front wall 16 includes the third major top flap 34 hingedly connected to an upper transverse edge 36 of the front wall 16. The third major top flap 34 has a pair of top edge slits 38 disposed on the upper transverse edge 36 of the front wall 16, and the pair of slits 38 are adapted to receive the lock tabs 30. The side walls 20 and 22 include the respective minor flaps 40 and 42 hingedly connected to the upper transverse edges 44 and 46 of the side walls 20 and 22, respectively.

In the preferred embodiment, the container 10 is designed to have three cells which segregate and protect three varied products. The three cells are formed by use of a main partition wall 43 and a secondary partition wall 45. The main partition wall 43 divides the container 10 into two main cells, while the secondary partition wall 45 divides one of those two main cells into two sub-cells.

Figure 3:
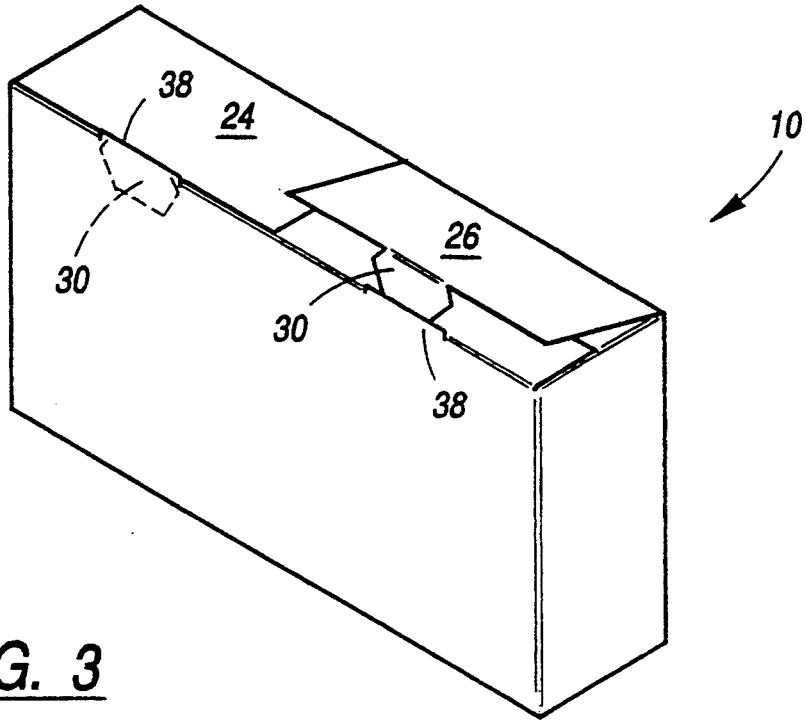
FIG. 3 is a perspective view of the recloseable paperboard container of the present invention, the container being shown in its reclosed condition.

After the tear strip is removed and the container 10 is opened, the container is reclosed in the manner described below. First, the minor flaps 40 and 42 are folded inward and downward. Next, the third major top flap 34 is folded inward and downward, followed by inward folding of the pair of major top flaps 24 and 26. Finally, as illustrated in FIG. 3, reclosure is obtained by securing each of the pair of major top flaps 24 and 26 over the third major top flap 34 and by engaging each of the edge lock tabs 30 with the corresponding locking slits 38.

Figure 4:
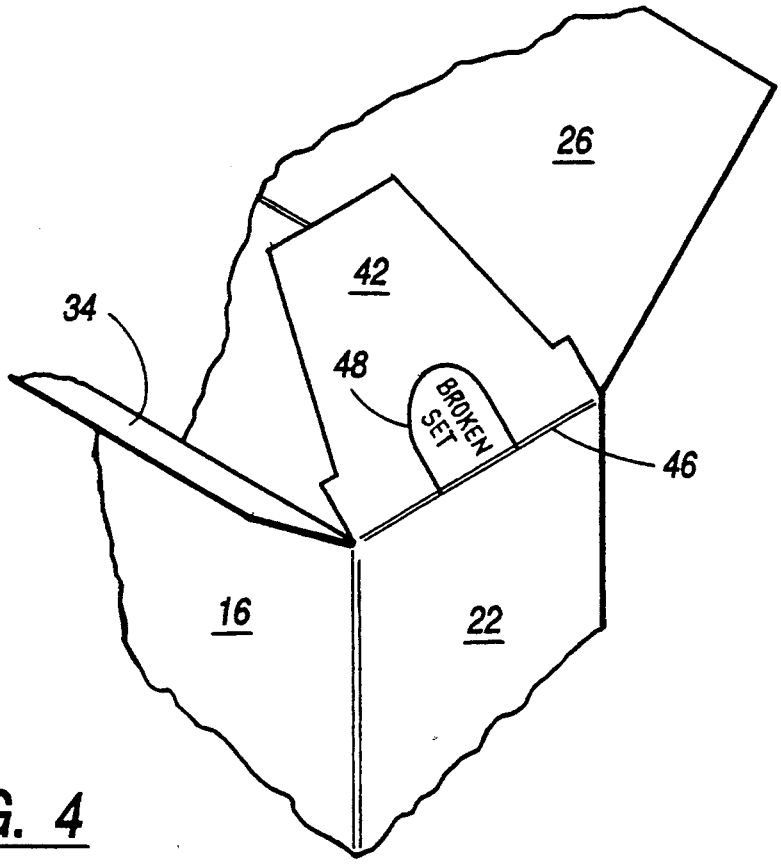
FIG. 4 is an enlarged perspective view of a "broken set" tag on a minor flap of the recloseable paperboard container of the present invention.

Once the container 10 has been opened and a portion of the product set contained therewithin has been removed, the container 10 includes a "broken set" tag 48 shown in FIG. 4 to indicate that the container 10 no longer contains a complete product set. The "broken set" tag 48 is hingedly connected to the upper transverse edge 46 of the side wall 22 and is linked to the top minor flap 42 by means of weakening nicks 49. To indicate that a product set is incomplete, the tag 48 is easily separated from the surrounding minor flap 42 by breaking the weakening nicks 49. When the container 10 is reclosed, the tag 48 is rotated outwardly and held in an approximately vertical orientation outside the folding range of the major top flaps 26 and 34 so that the tag 48 does not get secured beneath them. The separation of the tag 48 from the surrounding minor flap 42 indicates to a consumer that the container 10 contains a broken product set.

Figure 5:
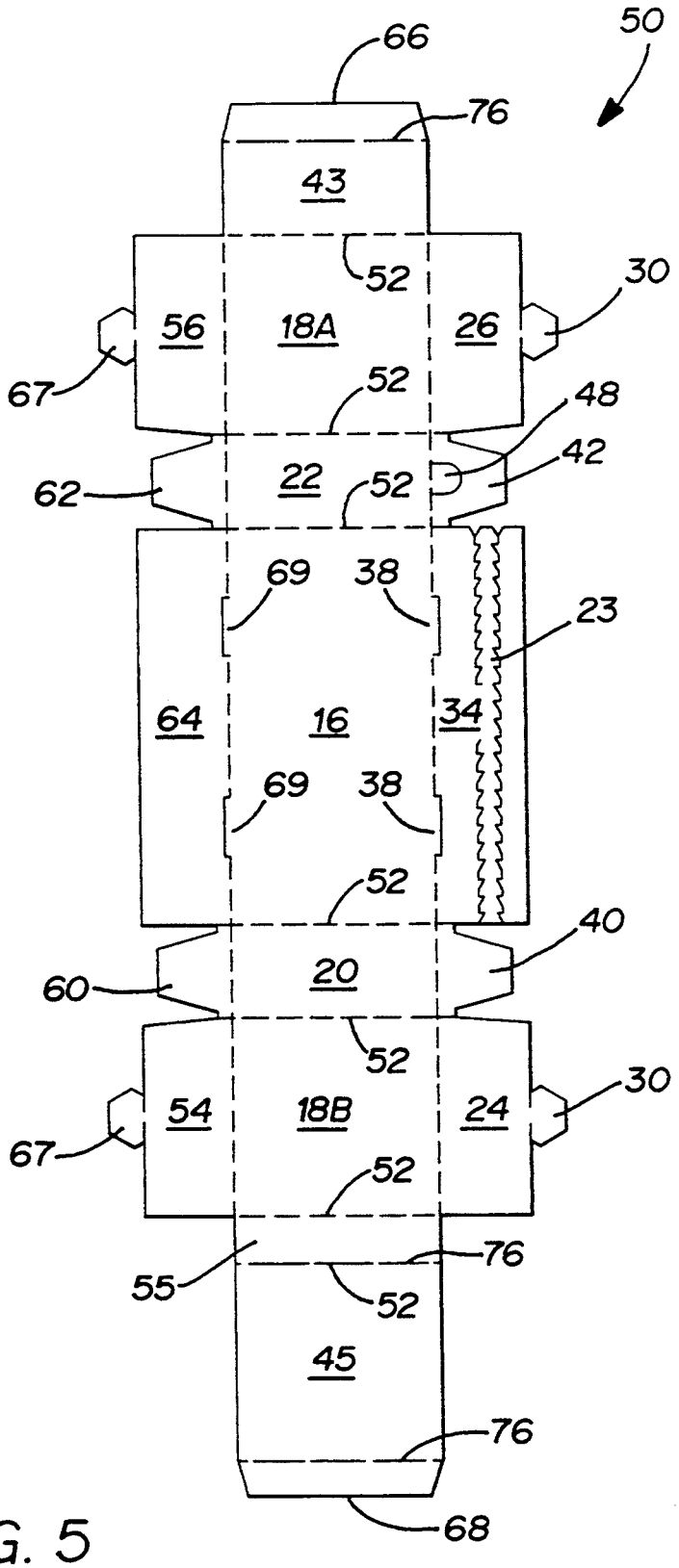
FIG. 5 is a plan view of the inside surface of a paperboard blank used to form the recloseable paperboard container of the present invention.

FIG. 5 is a plan view of an inner surface of a paperboard blank, generally designated by the reference numeral 50, used to form the recloseable paperboard container 10 of the present invention. The blank 50 is in the form of a single, planar, unitary section of paperboard which includes eight vertically aligned, substantially rectangular panels 43, 18A, 22, 16, 20, 18B, 55 and 45; all of which are linked to each other by means of horizontal score lines 52. The horizontal score lines 52 facilitate folding of the container panels relative to each other along the score lines.

To facilitate an understanding of how the panels interact to form the recloseable container 10 shown in FIGS. 1 and 2, the panels of the blank 50 already designated by reference numerals in FIGS. 1 and 2 are designated by the same reference numerals in FIG. 5. First and second side wall sections 18A and 18B form the side wall 18 of FIGS. 1 and 2. The panel 55, as will be shown later, functions as a partial partition wall which provides additional support to the main partition wall 43.

The panels 18A, 22, 16, 20 and 18B are provided with a pair of flaps connected along respective transverse edges by means of corresponding score lines. To better understand the relationship between the flaps and the recloseable container 10 of FIGS. 1 and 2, reference numerals are once again carried over to FIG. 5. More specifically, the first back wall section 18A includes a left end flap 56 and a right end flap 26, and the second back wall section 18B includes a left end flap 54 and a right end flap 24. Similarly, left end and right end flaps 62 and 42 are respectively associated with the side wall 22, and left and right end flaps 60 and 40 are respectively associated with the side wall 20. Finally, the front wall 16 includes a left end flap 64 and a right end flap 34.

In the illustrative embodiment of FIG. 5, the first back wall section 18A and its corresponding end flaps 56, 26 have substantially the same transverse (vertical) dimensions as the second back wall section 18B and its corresponding end flaps 54, 24. Also, the side wall 22 and its corresponding end flaps 62, 42 have substantially the same transverse dimensions as the side wall 20 and its corresponding end flaps 60, 40. However, the side walls 22 and 20 have transverse dimensions which are substantially smaller than the transverse dimensions of the other panels. Moreover, the transverse dimensions of the first and second back wall sections 18A and 18B are approximately equal to one-half of the transverse dimensions of the front wall 16 and its corresponding end flaps 64, 34.

In the embodiment of FIG. 5, the right end flap 34 of the front wall 16 has the transverse tear strip 23 extending across the flap. The design and structure of the tear strip 23 and its operation in effective sealing and convenient tearing-open of a container of the type disclosed herein is conventional and, accordingly, not described in detail herein. It suffices to state that the tear strip 23 is substantially in the form of a pair of transverse parallel lines which are comprised of regularly intermittent die cuts extending through the entire depth of the paperboard. The die cuts are situated close enough to each other so that the paperboard between the die cuts readily breaks as the tear strip 23 is removed during the unsealing operation.

Figure 6:
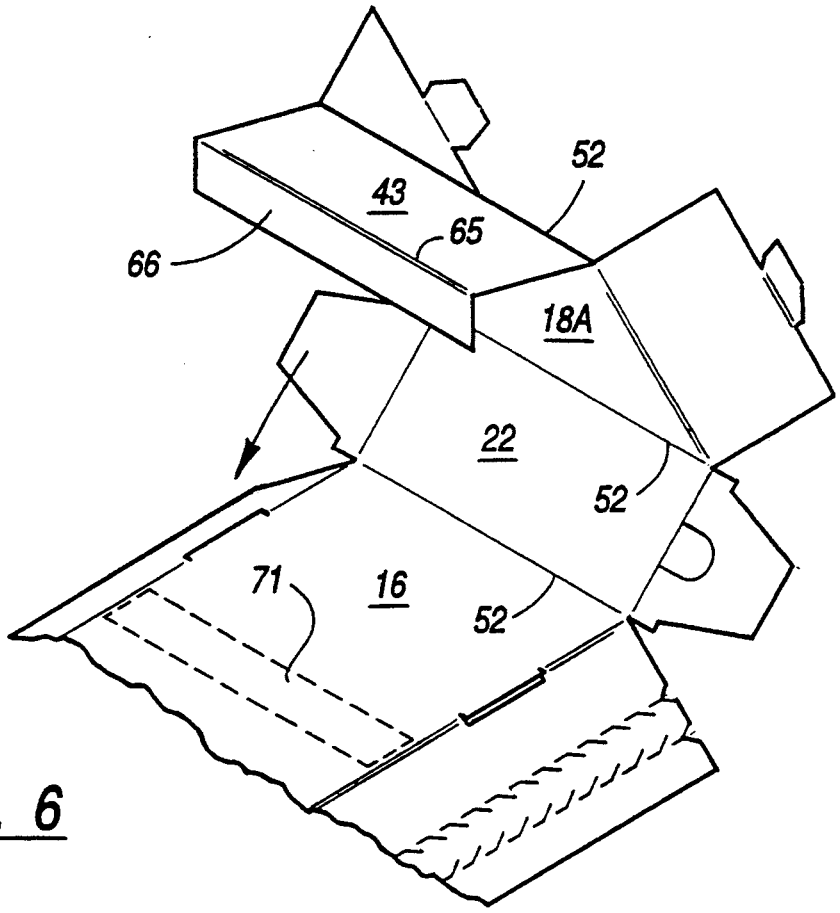
FIGS. 6 and 7 illustrate the sequence in which the upper panels of the paperboard blank of FIG. 5 are folded to form a first main cell of the recloseable paperboard container of the present invention.
Figure 7:
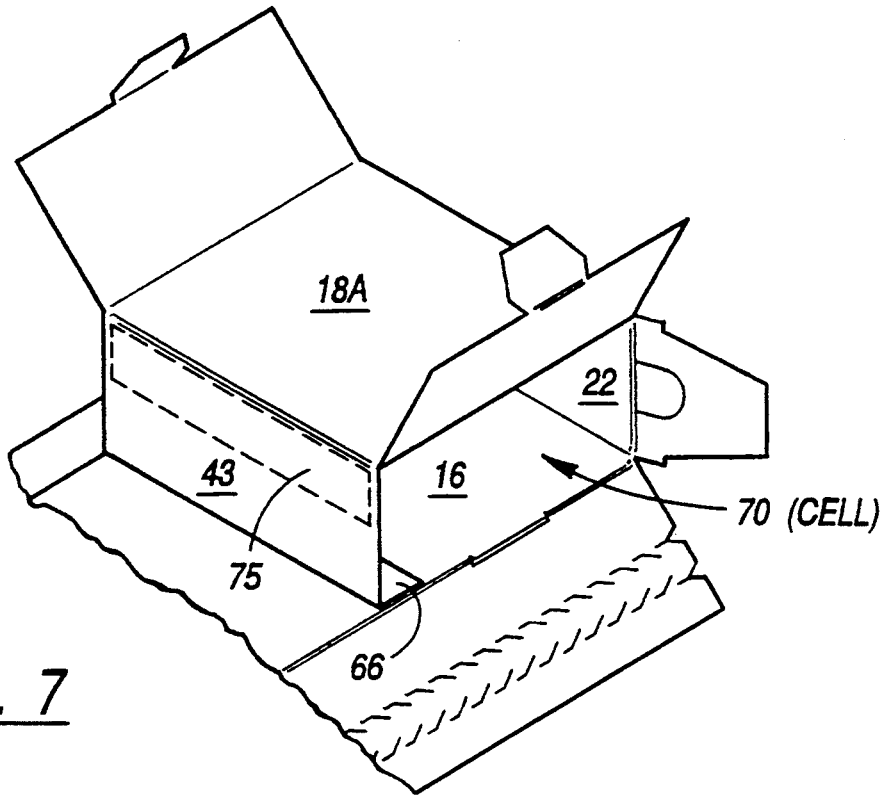

The manner in which the recloseable container 10 is formed from the paperboard blank 50 will be described by reference to FIGS. 6 through 12. FIGS. 6 and 7 illustrate the manner in which the panels 43, 18A, 22 and 16 cooperate to form a first main cell 70 of the recloseable container 10. To assist in forming the first main cell 70, the main partition wall 43 is provided with a glue flap 66 connected along a longitudinal edge by means of a score line 65.

To form the first main cell 70, the panels and glue flap are first folded in the direction of the arrow to form a four-sided tubular shape. In particular, the side wall 22 is folded to the extent of ninety degrees with respect to the front wall 16, the first back wall section 18A is folded ninety degrees with respect to the side wall 22, the main partition wall 43 is folded ninety degrees with respect to the glue flap 66, and the glue flap 66 is folded ninety degrees with respect to the main partition wall 43. An outer surface of the glue flap 66 is next secured by adhesive, such as glue, to a section 71 of the front wall 16 to form the first main cell 70.

Figure 8:
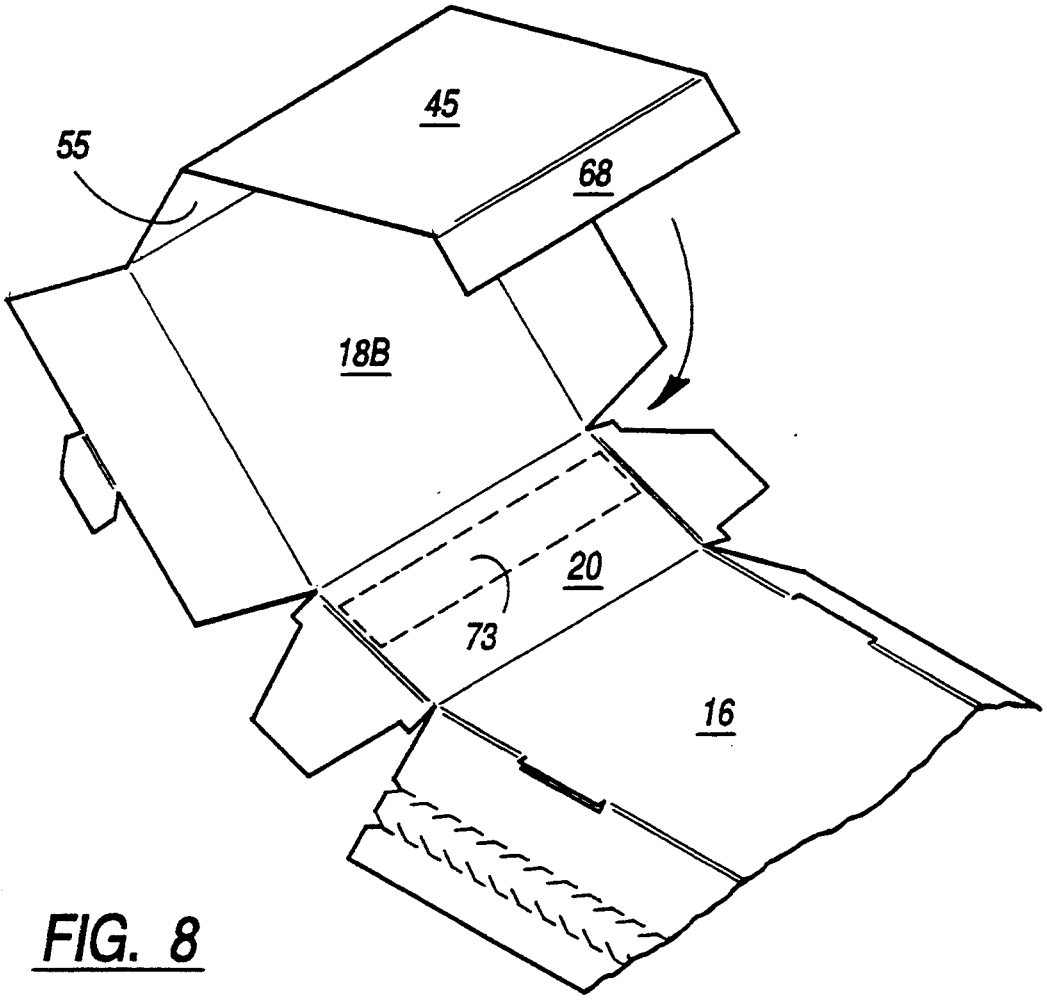
FIGS. 8 and 9 illustrate the sequence in which the lower panels of the paperboard blank of FIG. 5 are folded to form second and third cells of the recloseable paperboard container of the present invention.
Figure 9:
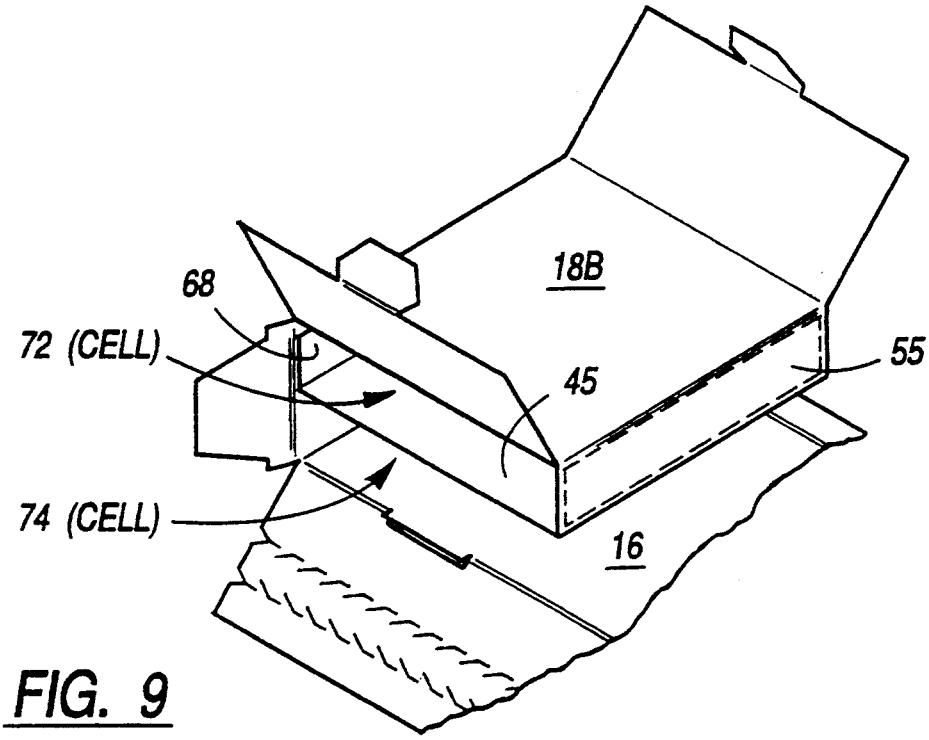

FIGS. 8 and 9 illustrate the manner in which the panels 45, 55, 18B, 20 and 16 cooperate to form second and third cells 72 and 74 of the recloseable container 10. First, the panels 45, 55, 18B and 20 and a glue flap 68 are folded in the direction of the arrow to form a four-sided tubular shape. More specifically, the side wall 20 is folded ninety degrees with respect to the front wall 16; the second back wall section 18B is folded ninety degrees with respect to the side wall 20; the partial partition wall 55 is folded ninety degrees with respect to the second back wall section 18B; the secondary partition wall 45 is folded ninety degrees with respect to the partial partition wall 55; and the glue flap 68 is folded ninety degrees with respect to the secondary partition wall 45.

Second, an outer surface of the glue flap 68 is secured by adhesive, such as glue, to a section 73 of the side wall 20 to form the second container cell 72. Finally, the third cell 74 is formed by adhering a section 75 of the main partition wall 43 shown in FIG. 7 to the partial partition wall 55 shown in FIG. 9.

Figure 10:
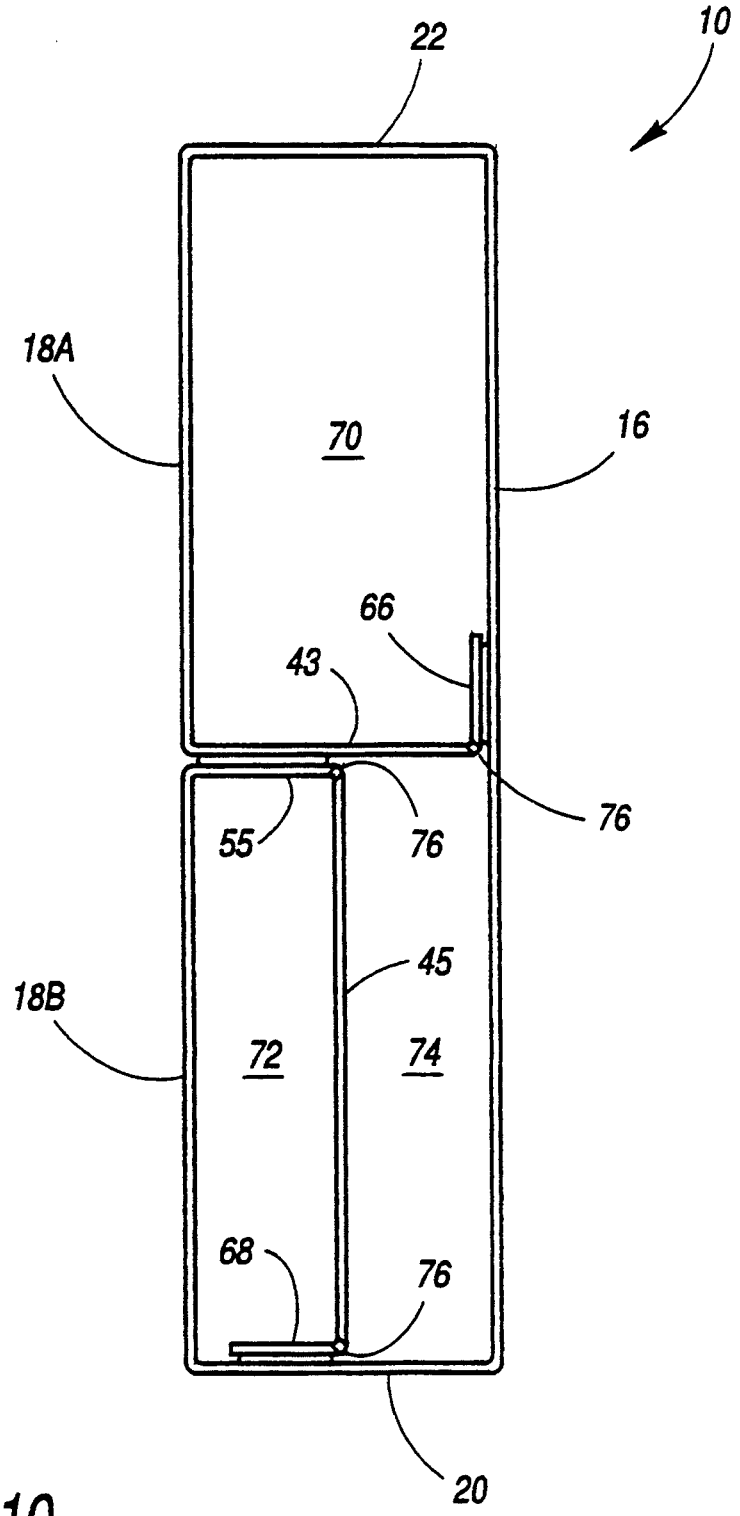
FIG. 10 is a cross-sectional view (or end view) illustrating the three cells of the recloseable paperboard container and illustrating the panels and glue flaps which form the three cells.

FIG. 10 is a cross-sectional view (or end view) of the recloseable container 10 illustrating the three cells 70, 72 and 74 formed by folding the panels and glue flaps of the paperboard blank 50 and adhering them to one another in the aforementioned manner. In the preferred embodiment, the second and third cells 72 and 74 are each approximately one-half the size of the first main cell 70.

The three cells 70, 72 and 74 are designed to segregate three varied products respectively contained therein. Effective protection of the container 10 and the contained products is achieved through the manner in which the cells are formed. For example, by facing the glue flap 66 in the direction of the first main cell 70, instead of away from it, the glue flap 66 affords greater resistance against tearing away from an inner surface of the front wall 16. Similarly, by facing the glue flap 68 towards the second cell 72, the glue flap 68 is more tear-resistant than if it were faced away from the second cell 72.

In addition, the first main cell is strengthened by perpendicular support afforded to it by the secondary partition wall 45. The secondary partition panel 45 prevents the main partition wall 43 from sagging inwardly towards the second and third cells 72 and 74. When a filled and sealed container is dropped on the side wall 20, the secondary partition wall 45 creates a "spring-like" action through bowing of paperboard affording a cushioning effect for a product contained in the first main cell 70. Both the first main cell 70 and the second cell 72 are strengthened by a double paperboard thickness created by adhering the partial partition wall 55 to the main partition wall 43. Furthermore, the main partition wall 43, with partial assistance from the partial partition wall 55, affords the container 10 greater crush protection in the direction of the front wall 16 to the back wall 18A, 18B than can be realized through conventional containers.

In the preferred embodiment, further protection of the container 10 is provided by regularly-spaced knife cuts 76 on three score lines corresponding to the intersection of the glue flap 66 and the main partition wall 43, the intersection of the secondary partition wall 45 and the partial partition wall 55, and the intersection of the secondary partition wall 45 and the glue flap 68. The knife cuts 76 are spaced along the above three score lines (looking into the page in FIG. 10) such that a product moving around inside the container cells will not strike against the knife cuts 76 but rather will strike along the score lines between the knife cuts. That is, the knife cuts 76 are not in direct alignment with an outer surface of a product within the container 10. For example, if ring-shaped products are placed in the three cells and are sized and arranged so that their outer circumferences are in direct alignment with a center portion of the score lines, then the knife cuts 76 are positioned above and below the center portion of the score lines. Such positioning of the knife cuts 76 reduces the amount of stress imposed on the container 10 by contained products. As a result, the knife cuts 76 assist in protecting the container against tearing-damage caused by the products contained therein when the container is ill-handled or otherwise abused.

Once the paperboard container 10 has been formed from the paperboard blank 50 as described in connection with FIGS. 6 through 9, the container 10 may be closed either by automatic sealing equipment or by hand. If the container 10 is produced and filled with products at the same manufacturing center, automatic sealing equipment is typically used. If, however, the container 10 is to be filled with products at a different location from where the container 10 is produced, then the container 10 is typically closed by hand.

Figure 12:
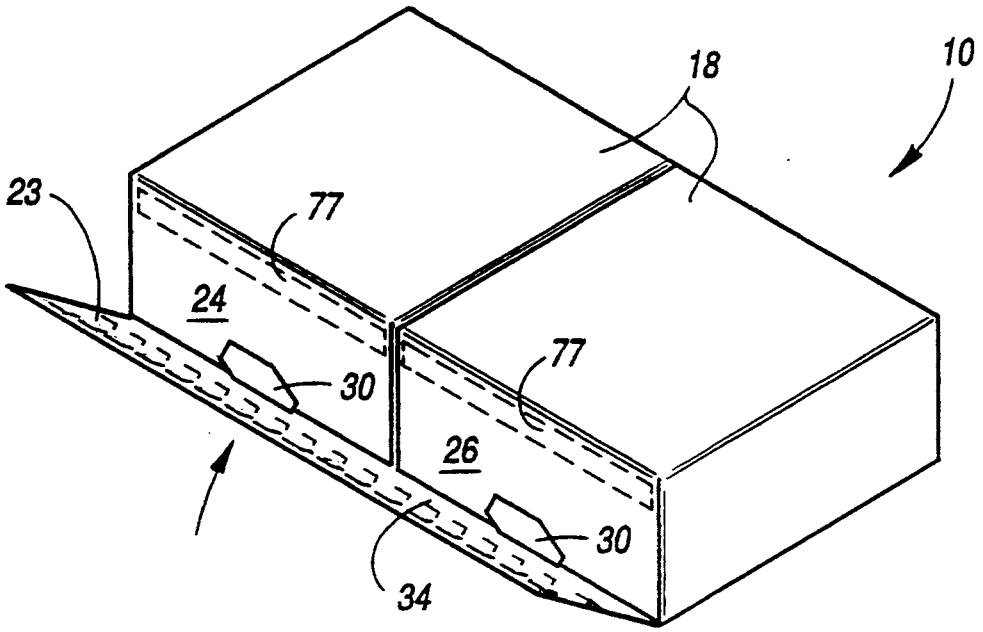

When automatic sealing equipment is used, the top of the container 10 is initially sealed as illustrated in FIGS. 11 and 12. To begin with, the minor top flaps 40 and 42 are folded inward and downward. Next, the first and second major top flaps 24 and 26 are folded inward and downward with the edge lock tabs 30 being back-folded 180 degrees. The third major top flap 34 is then folded inward and downward over the first and second major top flaps 24 and 26 in the direction of the arrow of FIG. 12. This results in the edge lock tabs 30 being "trapped" between an inner surface of the third major top flap 34 and an outer surface of the first and second major top flaps 24 and 26. Finally, an edge portion 80 of the inner surface of the third major top flap 34 is secured by adhesive, such as glue, to sections 77 of the outer surface the first and second major top flaps 24 and 26. In forming the top wall 12 of the container 10, the outer portion 80 is located between the tear strip 23 and an outer edge of the third major top flap. A consumer opens an automatically-sealed container 10 by removing the tear strip 23 as illustrated in FIG. 1, and recloses the container 10 by engaging the top edge lock tabs 30 with the edge lock slits 38 as shown in FIG. 3.

Referring to the paperboard blank 50 of FIG. 5, except for the tear strip 23, the left end flaps 56, 62, 64, 60 and 54 for forming the bottom wall of the container mirror the right end flaps 26, 42, 34, 40 and 24 which form the top wall. Moreover, mechanical closure of these left end flaps occurs in analogous fashion to the above-described mechanical closure of the right end flaps. When the container is formed from the blank 50, the left end flaps 60 and 62 function as minor bottom flaps, left end flaps 54 and 56 function as first and second major bottom flaps, and left end flap 64 functions as a third major bottom flap. Tabs 67 of the left end flaps 54 and 56 function as bottom edge lock tabs. Mechanical closure is achieved by first folding the minor bottom flaps 60 and 62, next folding the first and second major bottom flaps 54 and 56 with the edge lock tabs 67 back-folded over themselves, and finally folding the third major bottom flap 64 and adhering it to an outer surface of the first and second major bottom flaps 54 and 56.

Alternatively, the top of the container 10 may be initially closed by hand by bringing into immediate use the top edge slits 38 disposed on the upper transverse edge 36 of the front wall 16. The container 10 is initially closed in the manner shown in FIGS. 2 and 3, except that the tear strip 23 is not removed and does not play a role in closure. More specifically, the minor top flaps 40 and 42 are first folded inward and downward; the third major top flap 34 is next folded inward and downward; and finally the pair of major top flaps 24 and 26 are folded inward and downward with the top edge lock tabs 30 engaging the edge lock slits 38 as the primary closure means. There is no adhesive such as glue applied in the above closure process. A consumer opens a hand-sealed container 10 by disengaging the top edge lock tabs 30 from the edge lock slits 38, and recloses the container 10 by re-engaging the lock tabs 30 with the lock slits 38.

Similarly, bottom closure by hand involves first folding the minor bottom flaps 60 and 62 (see FIG. 5), next folding the third major bottom flap 64, and finally folding the first and second major bottom flaps 54 and 56 and engaging the bottom edge lock tabs 67 with bottom edge lock slits 69.

It is believed that the recloseable paperboard container and its attendant advantages will be understood from the foregoing description. It will be apparent that various changes may be made in the form, construction and arrangement of the parts thereof without departing form the spirit and scope of the invention or sacrificing all of its material advantages, the form hereinbefore described being merely a preferred or exemplary embodiment thereof.

What is claimed is:

1. A recloseable paperboard container, comprising:

opposing top and bottom walls, opposing front and back walls, and opposing side walls;

a main partition wall, extending between and connected to the opposing front and back walls, thereby dividing the container into first and second main cells; and a secondary partition wall extending between said main partition wall and one of said side walls, thereby dividing said first main cell into first and second sub cells;

wherein the back wall includes first and second major top flaps associated with the respective first and second main cells and hingedly connected to an upper transverse edge of the back wall, the first major top flap having a first top edge lock tab protruding from an outer edge of the first major top flap, and the second major top flap having a second top edge lock tab protruding from an outer edge of the second major top flap;

wherein the front wall includes a third major top flap hingedly connected to an upper transverse edge of the front wall, the third major top flap having first and second top edge slits disposed on the upper transverse edge of the front wall, the first and second top edge slits being adapted for receiving the respective first and second top edge lock tabs of the respective first and second major top flap, the third major top flap including an integral tear strip extending across the third major top flap substantially parallel to the upper transverse edge of the front wall;

further including closure means for folding the third major top flap over the first and second major top flaps and securing an inner surface of the third major top flap to outer surfaces of the first and second major top flaps to form the top wall; and wherein the top wall is opened by pulling the tear strip to disengage the outer surface of the first and second major top flaps from the inner surface of the third major top flap, and wherein the top wall is reclosed by engaging the first and second top edge lock tabs with the respective first and second top edge slits.

2. The paperboard container as recited in claim 1, wherein the closure means includes folding the first and second top edge lock tabs back over themselves and trapping the first and second top edge lock tabs between the first and second major top flaps and the third major top flap.

3. The paperboard container as recited in claim 2, wherein the back wall includes a first major bottom flap hingedly connected to a lower transverse edge of the back wall, and wherein the front wall includes a second major bottom flap hingedly connected to a lower transverse edge of the front wall, the second major bottom flap cooperating with the first major bottom flap to form the bottom wall of the container.

4. The paperboard container as recited in claim 3, wherein the first major bottom flap includes a bottom edge lock tab protruding from an outer edge of the first major bottom flap, and wherein the second major bottom flap includes a bottom edge slit disposed on the lower transverse edge of the front wall, the bottom edge slit being adapted for receiving the bottom edge lock tab of the first major bottom flap to form the bottom wall of the container.

5. The paperboard container as recited in claim 3, wherein an inner surface of the second major bottom flap is adhered to an outer surface of the first major bottom flap to form the bottom wall of the container.

6. The paperboard container as recited in claim 5, wherein the first major bottom flap includes a bottom edge lock tab protruding from an outer edge of the first major bottom flap, and wherein the bottom edge lock tab is folded back over itself and trapped between the first major bottom flap and the second major bottom flap.

7. The paperboard container as recited in claim 1, wherein each of the opposing side walls includes a minor top flap hingedly connected to an upper transverse edge of the respective side wall and a minor bottom flap hingedly connected to a lower transverse edge of the respective side wall, and wherein the container further includes an identification tag means for indicating that the container has been previously opened and that a product has been removed.

8. The paperboard container as recited in claim 7, wherein the identification tag means includes a die-cut tab portion disposed on one of the minor flaps.

* * * * *

UNITED STATES PATENT AND TRADEMARK OFFICE

CERTIFICATE OF CORRECTION

PATENT NO. : 5,366,141

DATED : August 9, 1994

INVENTOR(S) : Larry W. Vittone

It is certified that error appears in the above-indentified patent and that said Letters Patent is hereby corrected as shown below:

column 5, line 56 after "links" delete "110,112" and insert --110, 112--.

column 8, line 9 after "50" delete "5240" and insert --52'--.

column 8, line 17 after "so" delete "10".

column 9, line 11 after "suspended" delete "form" and insert --from--.

column 10, line 8 after "cross-member" delete "60"'" and insert --60"--.

Signed and Sealed this

Twenty-second Day of November, 1994

*Attest:*

Bruce Lehman

BRUCE LEHMAN

*Attesting Officer*

*Commissioner of Patents and Trademarks*